US010478953B2

(12) United States Patent
Green

(10) Patent No.: US 10,478,953 B2
(45) Date of Patent: Nov. 19, 2019

(54) VALVE CORE REMOVAL TOOL

(71) Applicant: DIVERSITECH CORPORATION, Duluth, GA (US)

(72) Inventor: Matthew Christopher Green, Amherst, MA (US)

(73) Assignee: Diversitech Corporation, Duluth, GA (US)

( * ) Notice: Subject to any disclaimer, the term of this patent is extended or adjusted under 35 U.S.C. 154(b) by 57 days.

(21) Appl. No.: 15/205,362

(22) Filed: Jul. 8, 2016

(65) Prior Publication Data

US 2017/0008157 A1 Jan. 12, 2017

Related U.S. Application Data

(60) Provisional application No. 62/190,030, filed on Jul. 8, 2015.

(51) Int. Cl.
*B25B 27/24* (2006.01)

(52) U.S. Cl.
CPC ..... *B25B 27/24* (2013.01); *Y10T 29/53552* (2015.01)

(58) Field of Classification Search
CPC ..... B25B 27/06; B25B 27/14; B25B 27/24; Y10T 29/53596
See application file for complete search history.

(56) References Cited

U.S. PATENT DOCUMENTS 3,718,057 A * 2/1973 Berchtold ..... B60C 25/18 81/15.4
3,840,967 A * 10/1974 Olson ..... B25B 27/24 137/328
3,935,713 A * 2/1976 Olson ..... B25B 27/24 29/221.6
4,305,193 A * 12/1981 Anderson ..... B25B 27/24 29/213.1
4,651,596 A * 3/1987 Rachanski ..... B25B 13/44 29/264
5,472,011 A 12/1995 St. Marie
5,875,534 A * 3/1999 Jackson ..... B25B 27/02 29/255
6,122,810 A * 9/2000 McInnes ..... B25B 27/023 29/255
6,152,165 A * 11/2000 Fukuda ..... B25B 13/48 137/223

(Continued)

*Primary Examiner* — Tyrone V Hall, Jr.
(74) *Attorney, Agent, or Firm* — Dentons US LLP

(57) ABSTRACT

A valve core removal tool can include a shaft having a proximal end and a distal end. A valve core gripper can be coupled to the distal end of the shaft and can include a first valve core engaging surface and an opposing second valve core engaging surface spaced therefrom. The first and second valve core engaging surfaces can be flexible and movable relative to each other between a first position, where the free ends of the first and second valve core engaging surfaces are spaced apart a first distance, and a second position, where the free ends of the first and second valve core engaging surfaces are spaced apart a second distance that is greater than the first distance. The first and second valve core engaging surfaces can be spring-biased in the first position for gripping a valve core between the first and second valve core engaging surfaces.

21 Claims, 7 Drawing Sheets

(56) References Cited

U.S. PATENT DOCUMENTS

| | | | | |
|---|---|---|---|---|
| 6,253,436 | B1 * | 7/2001 | Barjesteh | B25B 27/24 29/213.1 |
| 6,862,787 | B2 | 3/2005 | Groves | |
| 6,901,947 | B2 | 6/2005 | Danielson et al. | |
| 6,944,924 | B2 | 9/2005 | Hayes | |
| 7,559,245 | B2 * | 7/2009 | Knowles | F25B 45/00 73/700 |
| 8,505,420 | B2 * | 8/2013 | Alfaro | B25G 1/10 206/350 |
| 9,278,439 | B1 * | 3/2016 | Krause | B25B 27/24 |
| 2004/0016096 | A1 * | 1/2004 | Capoferi | B25B 27/0028 29/213.1 |
| 2004/0088824 | A1 * | 5/2004 | Hsien | B25G 1/00 16/111.1 |
| 2007/0143978 | A1 | 6/2007 | Stewart | |
| 2008/0127472 | A1 | 6/2008 | Whitehead et al. | |
| 2015/0165570 | A1 * | 6/2015 | Schmidt | B25B 27/14 29/243.517 |

* cited by examiner

VALVE CORE REMOVAL TOOL

CROSS-REFERENCE TO RELATED APPLICATION

This application claims priority under 35 U.S.C. § 119 to U.S. Provisional Patent Application No. 62/190,030 filed Jul. 8, 2015, and titled "Valve Core Removal Tool," the entire contents of which are hereby incorporated herein by reference for all purposes.

TECHNICAL FIELD

The present disclosure relates generally to valve core removal tools, and more particularly, to valve core removal tools having flexible grips for gripping and removing valve cores.

BACKGROUND

A conventional valve core removal tool can include a plunger and a device located at the distal end of the plunger for positioning about the exterior of the valve core. One of the drawbacks is that conventional valve core removal tools are not able to securely grip valve cores. Instead, they are simply configured to have arms that are spaced a distance greater than the diameter of the valve core to slidably receive the valve core between the arms. Conventional valve core removal tools can be further configured to rotate the valve core by engaging the flats on the valve core. In addition, conventional valve core removal tools are configured for a specific size and/or shape of valve core and are not designed to work with and remove a number of varying styles or shapes of valve cores on the market. As such, these conventional valve core removal tools do not accommodate the wide range of variables encountered in valve core removal, such as variables in valve core dimensions, tolerances, materials, shape, damage and wear.

Another drawback of conventional valve core removal tools is that the valve core grips include components, such as o-rings or similar pliable materials, positioned between the valve core grip that are designed to wear out. In many cases, these components can prematurely wear out, reducing the overall usefulness of the valve core removal tool. Yet another drawback of conventional valve core removal tools is that they do not provide a tactile feedback when gripping a valve core. As such, a user may not know whether or not the tool has successful engaged and grabbed on to the valve core during a removal process. Another drawback of some conventional valve core removal tools is that they do not provide a solution for storing the tool at a jobsite when not in use or when the valve core is being held by the valve core removal tool, after removal of the valve core from the valve. As a result, the valve core removal tool and/or the valve core can become lost or misplaced during servicing of a system.

BRIEF DESCRIPTION OF THE DRAWINGS

Reference will now be made to the accompanying drawings, which are not necessarily drawn to scale.

DETAILED DESCRIPTION OF EXAMPLE EMBODIMENTS

Example embodiments will now be described more fully hereinafter with reference to the accompanying drawings, in which example embodiments are shown. The concepts disclosed herein may, however, be embodied in many different forms and should not be construed as limited to the example embodiments set forth herein. Rather, these embodiments are provided so that this disclosure will be thorough and complete, and will fully convey the scope of the concepts to those skilled in the art. Like numbers refer to like, but not necessarily the same or identical, elements throughout.

Certain dimensions and features of the example valve core removal tool are described herein using the term "approximately." As used herein, the term "approximately" indicates that each of the described dimensions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships between dimensions of the example valve core removal tool and between features of the example valve core removal tool are described herein using the terms "substantially" and "substantially equal." As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially constant" indicates that the constant relationship is not a strict relationship and does not exclude functionally similar variations therefrom. As used herein, the term "substantially parallel" indicates that the parallel relationship is not a strict relationship and does not exclude functionally similar variations therefrom. As used herein, the terms "substantially perpendicular" and "substantially orthogonal" indicate that the perpendicular relationship is not a strict relationship and does not exclude functionally similar variations therefrom.

Figure 1A:
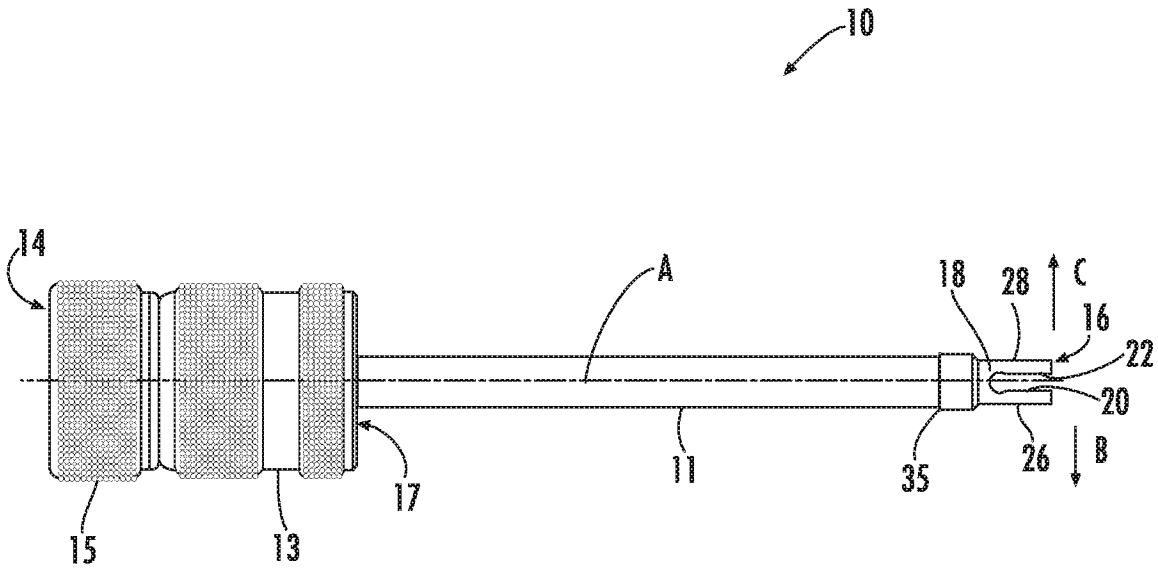
FIG. 1A is a side elevation view of a valve core removal tool, in accordance with one example embodiment of the disclosure.
Figure 1B:
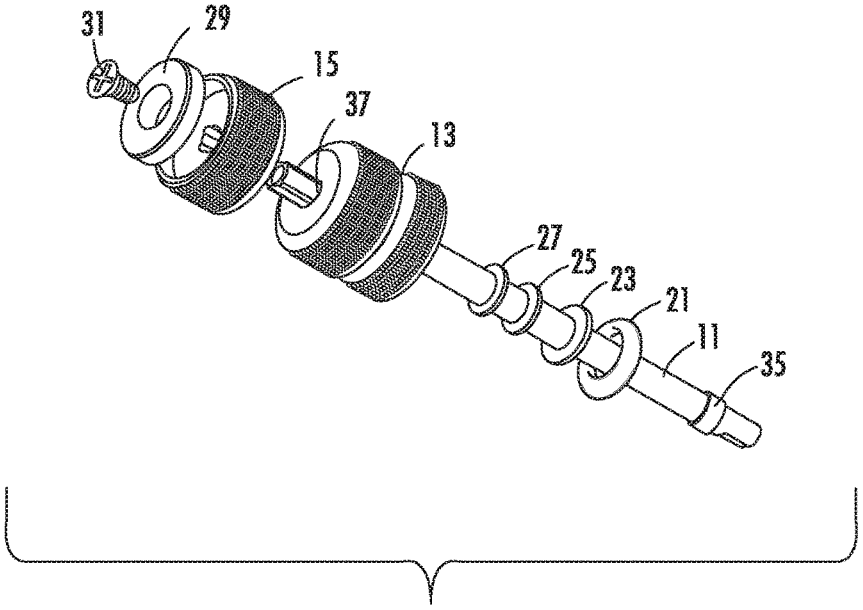
FIG. 1B is an exploded view of the valve core removal tool of FIG. 1A, in accordance with one example embodiment of the disclosure.
Figure 1C:
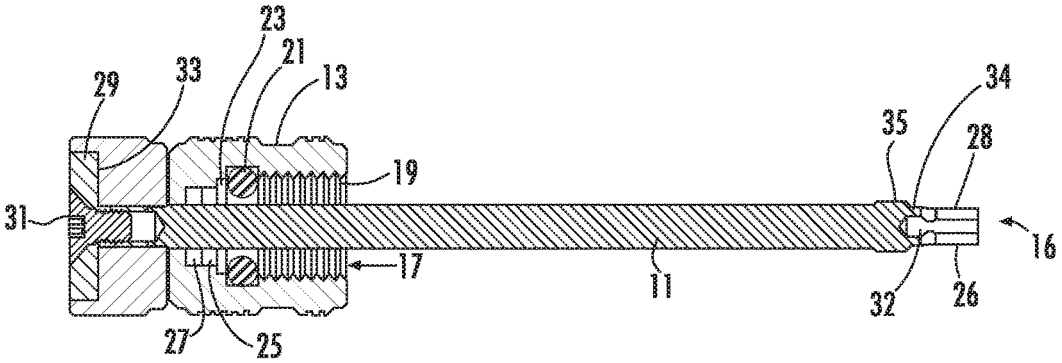
FIG. 1C is a cross-sectional view of the valve core removal tool of FIG. 1C, in accordance with one example embodiment of the disclosure.

FIGS. 1A-1C are various views of a valve core removal tool 10 according to one example embodiment of the disclosure. Referring now to FIGS. 1A-1C, the example valve core removal tool 10 can include a shaft 11. In one example, the shaft 11 is a straight or substantially straight shaft made of metal, plastic, or composite materials and has a longitudinal axis "A". The shaft 11 has a first proximal end along the longitudinal axis A and positioned adjacent a proximal end 14 of the valve core removal tool 10 and a second distal end along the longitudinal axis A and positioned towards a distal end 16 of the tool 10. In one example, the shaft 11 has a circular cross-sectional shape when viewed orthogonal to the longitudinal axis A. The circular cross-sectional shape has a first diameter. In other example embodiments, the cross-sectional shape of the shaft 11 can be oval, pentagonal, hexagonal, or any other geometric or non-geometric shape.

The valve core removal tool 10 can also include a shoulder stop 35. The shoulder stop 35 can have a second diameter that is greater than the first diameter of the shaft 11. In one example embodiment, the shoulder stop 35 can have a cross-sectional shape that corresponds to the cross-sectional shape of the shaft 11. The shoulder stop 35 can be positioned at or near the distal second end of the shaft 11 in certain embodiments. In other embodiments, the shoulder stop can be positioned anywhere on the shaft along the longitudinal axis A.

The valve core removal tool 10 can also include a plunger handle 15. The plunger handle 15 can include a top aperture and an opposing bottom aperture that define a channel through the plunger handle 15 in the direction of the longitudinal axis A for receiving at least a portion of the shaft 11 therethrough. The example plunger handle 15 can be coupled to the first proximal end of the shaft 11 with a coupling device 31. The coupling device can be a screw, bold, rivet, nail, or any other coupling device known to those of ordinary skill in the art for fixedly coupling one apparatus to another. In one example, the first proximal end of the shaft 11 can include a threaded aperture that extends along the longitudinal axis A of the shaft 11 for rotatably coupling the coupling device to the first proximal end of the shaft 11. The plunger handle 15 can be fixedly coupled to the proximal end of the shaft 11 such that is does not move along the longitudinal axis of the shaft 11 in use. The plunger handle 15 can have an ergonomic outer shape configured for gripping the plunger handle 15. In one example, the cross-section of the outer shape of the plunger handle 15 orthogonal or substantially orthogonal to the longitudinal axis A is circular, generally circular, or substantially circular. However, other shapes, such as oval, hexagonal or other geometric or non-geometric shapes are within the scope of this disclosure. The plunger handle 15 can also include a raised, dimpled, or studded outer surface to promote the grippability of the plunger handle 15.

In certain example embodiments, the plunger handle 15 can include a flat bottom surface and a recessed flat or substantially flat top surface 33. The recessed top surface 33 can be recessed vertically inward from the outer side surfaces of the plunger handle 15. A magnet 29 can be disposed within the recessed top surface of the plunger handle 15. The magnet 29 can include an aperture providing a channel through the magnet 29 for receiving at least a portion of the shaft 11 therethrough. The magnet 29 can also include a flat or substantially flat top surface for magnetically coupling the valve core removal tool to a magnetic or ferrous-containing surface. In one example embodiment, the magnet 29 is disc-shaped.

The valve core removal tool 11 can also include a swivel nut 13. The swivel nut 13 can include a top end and a distal bottom end. The swivel nut 13 can include a first threaded aperture 17 that extends from its bottom end and extends upward toward the top end of the swivel nut 13. Along the internal wall defined by the first threaded aperture 17, the swivel nut 13 can include screw threads for screwing the swivel nut 13 onto a portion of a valve. The swivel nut 13 can also include a second top aperture 37. In one example, the second top aperture can have a shape that corresponds to the cross-sectional shape of the shaft 11. The first threaded aperture 17 and the second top aperture 37 can generally define a cavity through the swivel nut 13 in the direction of the longitudinal axis A for receiving at least a portion of the shaft 11 therethrough. In one example, the diameter of the top aperture 37 can be less than the diameter of the threaded aperture 17. Further, the diameter of the top aperture 37 can be greater than the diameter of the shaft 11 and less than the diameter of the outer perimeter of the shoulder stop 35. In this example, the swivel nut 13 can be adjustable along the longitudinal axis A of the shaft 11 from a first position, where the top surface of the swivel nut 13 can abut the bottom surface of the plunger handle 15 to a second position, where the shoulder stop 35 abuts or otherwise contacts the outer perimeter of the second top aperture 37 and prevents the swivel nut 13 from moving further downward along the longitudinal axis A of the shaft 11.

The swivel nut 13 can have an ergonomic outer shape configured for gripping the swivel nut 13. In one example, the cross-section of the outer shape of the swivel nut 13 orthogonal or substantially orthogonal to the longitudinal axis A is circular, generally circular, or substantially circular. However, other shapes, such as oval, hexagonal or other geometric or non-geometric shapes are within the scope of this disclosure. The swivel nut 13 can also include a raised, dimpled, or studded outer surface to promote the grippability of the swivel nut 13.

In certain example embodiments, the swivel nut 13 can include one or more devices for promoting the fluidic sealing and slidability of the swivel nut 13 along the shaft 11. For example, the swivel nut 13 can include an o-ring 21 or other flexible sealing device disposed about the outer surface of the shaft 11 and having an aperture for receiving at least a portion of the shaft 11 therethrough. The o-ring 21 can be positioned generally adjacent the top end of the threads 19 within the channel of the swivel nut 13. The swivel nut 13 can also include a seal retainer 23 disposed about an outer surface of the shaft 11 and having an aperture for receiving at least a portion of the shaft 11 therethrough. In one example, the seal retainer 23 can be positioned generally adjacent the o-ring 21 within the channel of the swivel nut 13. The swivel nut can also include additional o-rings 25, 27. Each of the one or more additional o-rings 25, 27 can be disposed about the outer surface of the shaft 11 and include an aperture for receiving at least a portion of the shaft therethrough. Each of the one or more additional o-rings 25, 27 can be positioned within the channel of the swivel nut 13 between the seal retainer 23 and the second aperture 27.

The valve core removal tool 10 can also include a valve core grip 18 located at the distal end 16 of the valve core removal tool 10. In one example, the valve core grip 18 can be disposed adjacent the shoulder 35 along the longitudinal axis A of the shaft 11. The valve core grip 18 can include a first leg 26 defining a first valve core engaging surface 20, and a second leg 28 defining a second valve core engaging surface 22. Each of the first leg 26 and the second leg 28 can have a fixed end coupled to the distal end of the shaft 11 and/or shoulder stop 35 and a distal free end that extends out from the distal end of the shaft 11 along an axis that is parallel or substantially parallel to the longitudinal axis A of the shaft 11. The first leg 26 and second leg 28 can be diametrically or otherwise opposed and radially or laterally spaced relative to each other and/or a centerline of the longitudinal axis A of the shaft 11. In certain example embodiments, each of the first leg 26 and second leg 28 are flexible similar to a leaf spring and are configured to move from a first position, where the free ends of each of the first leg 26 and the second leg 28 are positioned a first distance from one another, to a second or flexed position, where the free ends of the first leg 26 and the second leg 28 are positioned a second distance from one another that is great than the first distance. The example first leg 26 and second leg 28 are spring-biased into the first position and are configured to rotate or flex outward away from the centerline of the shaft 11 in a direction B and C respectively in certain example embodiments.

Figure 2:
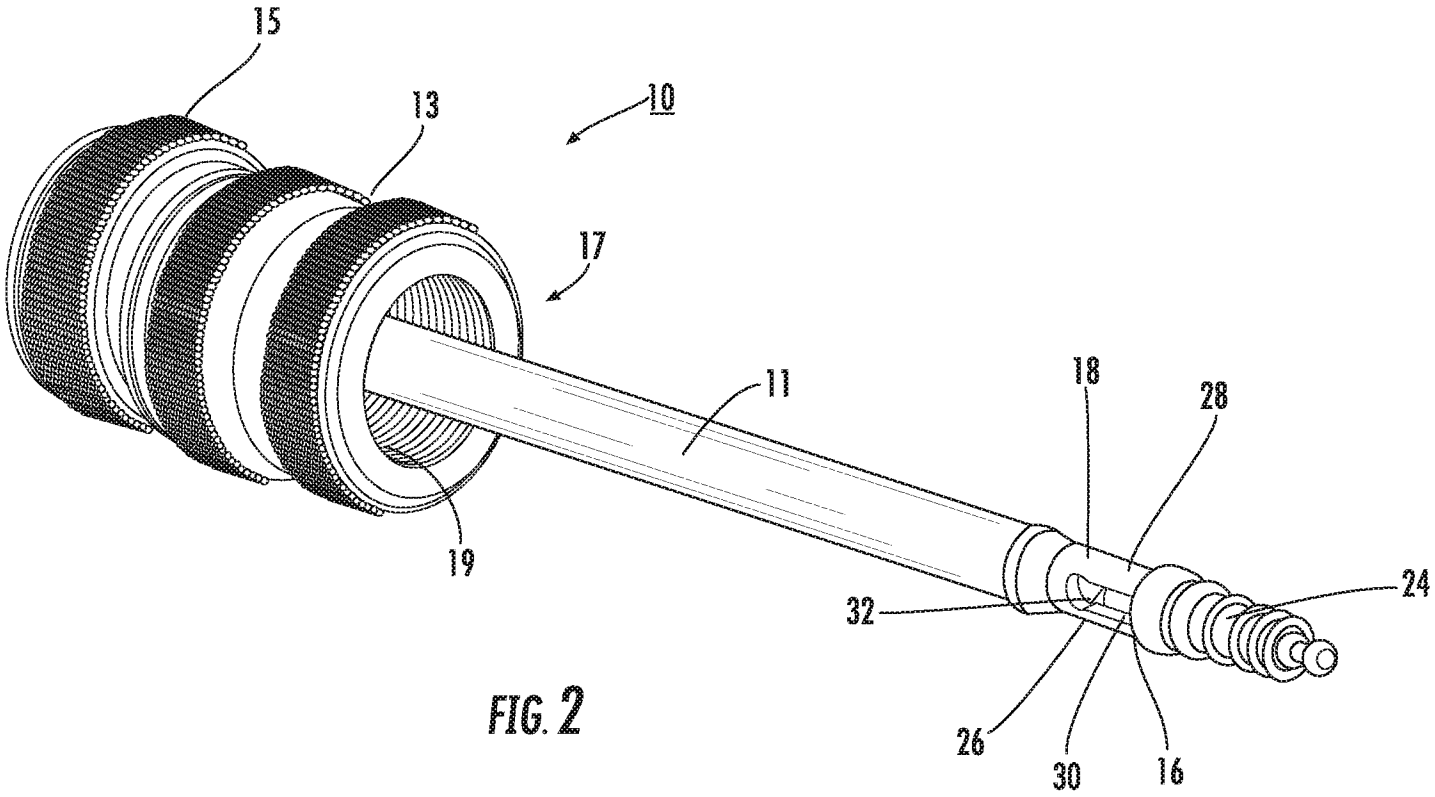
FIG. 2 is a perspective view of the valve core removal tool gripping a valve core, in accordance with one example embodiment of the disclosure.

The first leg 26 can include a first valve core engaging surface 20 and the second leg 28 can include an opposing, second valve core engaging surface 22 spaced from the first valve core engaging surface 20. The first 20 and the second 22 valve core engaging surfaces, each being a part of the corresponding first leg 26 and second leg 28 are movable relative to each other between a first position defining a first distance between the first 20 and second 22 valve core engaging surfaces, as shown in FIG. 1A, and a second or flexed position defining a second distance between the first 20 and second 22 valve core engaging surfaces that is greater than the first distance, as shown in FIG. 2. Each of the first valve core engaging surface 20 and second valve core engaging surface 22 can have a flat, substantially flat or radiused inner surface. In examples where the surface is radiused, it can have a radius of curvature about the longitudinal axis A such that the distance between the center of each of the first 20 and second 22 valve core engaging surfaces is greater than the distance between each of the side edges of the first 20 and second 22 valve core engaging surfaces.

As shown in FIGS. 1A-1C, each valve core engaging surface 20, 22, and the gap extending between the valve core engaging surfaces, extends throughout a substantial portion of the circumference of the shaft 11. In one example embodiment, each of the first valve core engaging surface 20 and the second valve core engaging surface 22 extends throughout an arc of about 70 degrees to about 110 degrees and more preferably about 80 degrees to about 100 degrees and more preferably about 85 degrees to about 95 degrees and more preferably about 90 degrees. As may be recognized by those of ordinary skill in the pertinent art, based on the teachings herein, the relative sizes, shapes, and/or dimensions of the first leg 26, second leg 28, first valve core engaging surface 20 and second valve core engaging surface 22, as well as the size and shape of the gap or distance therebetween described herein are provided as example only and may be changed as desired or otherwise required.

In certain example embodiments, the first leg 26 and the second leg 28 and their respective first 20 and second 22 valve core engaging surfaces are made of metal, such as spring steel. Alternatively, other flexible materials, such as flexible plastic or flexible composites may be used in constructing the first 26 and second 28 legs. Thus, the first valve core engaging surface 20 and the second valve core engaging surface 22 are able to flexibly engage and grip a valve core without encountering the drawbacks associated with the use of 0-rings or other wear components to grip valve cores as encountered in conventional valve core removal tools.

The spacing between the first valve core engaging surface 20 and the second valve core engaging surface 22 can define a passageway or channel for receiving at least a portion of a valve core therein. This channel can extend from the distal end 16 at the free end of each of the first leg 26 and the second leg 28 towards the shoulder stop 35 along the longitudinal axis A of the shaft 11. In one example embodiment, the channel can have a diameter that is less than the diameter of the at least a portion of the valve core that is to be received therein. As such, unless each of the first leg 26 and the second leg 28 flex outward to create a greater diameter in the channel, the valve core could not be received within the channel.

In certain example embodiments, the spacing between the first valve core engaging surface 20 and the second valve core engaging surface 22 is constant or substantially constant along the longitudinal axis A. In other example embodiments, the valve core gripper 18 can further include a first recess 32 formed at the proximal or fixed end of the first leg 26, and a second recess 34 formed at the proximal or fixed end of the second leg 28. Each of the first 32 and second 34 recesses facilitates flexing of the respective first leg 26 and second leg 28 between the first position and the second or flexed position. In one example embodiment, each of the first recess 32 and the second recess 34 is curvilinear are arcuate shaped. In an alternative embodiment, each of the first recess 32 and second recess 34 have one or more angled or linear surfaces that alone or collectively increase the distance between the inner surface of each of the first leg 26 and second leg 28, such that the distance between the first recess 32 and the second recess 34 decreases as you move from the proximal or fixed end of the respective first leg 26 or second leg 28 toward the respective free end. The first leg 26 and second leg 28 can then extend axially from the first 32 and second 34 recesses respectively toward the distal end 16 of the valve core removal tool 10.

Figure 6:
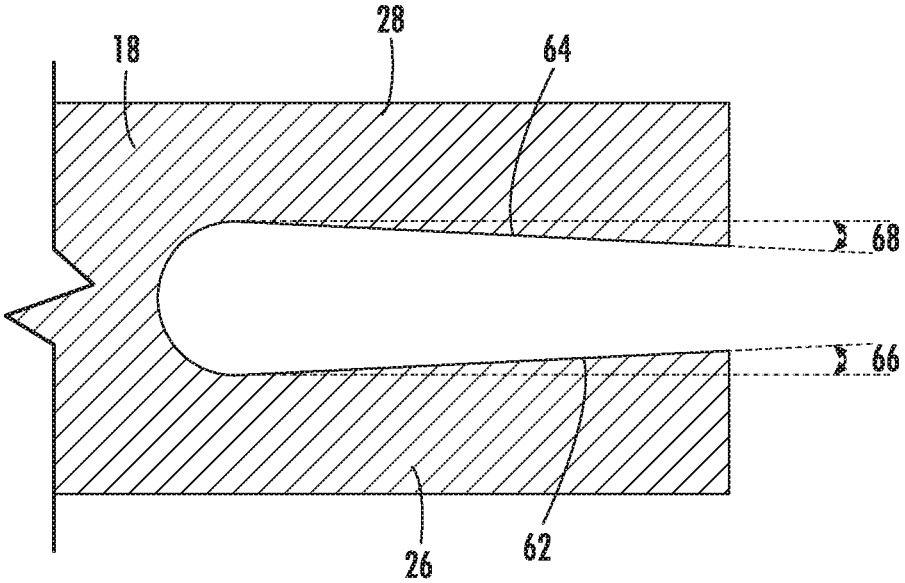
FIG. 6 is a partial side elevation view of another valve core grip for the valve core removal tool, in accordance with another example embodiment of the disclosure.

In another example embodiment, as shown in FIG. 6, each of the valve core engaging surfaces 62 and 64 can be disposed at an angle greater than zero to a plane parallel to the longitudinal axis A of the shaft 11. The valve core engaging surfaces 62 and 64 can each be angled such that the spacing between the first valve core engaging surface 62 and the second valve core engaging surface 64 increases as you move from the free ends of the first leg 26 and the second leg 28 towards the fixed end of each of the first leg 26 and the second leg 28. In one example, the rate of increase can be constant (e.g., a constant angle). In an alternative embodiment, the rate of increase can vary (e.g., a variable angle) as you move from the free ends of the first leg 26 and the second leg 28 towards the fixed end of each of the first leg 26 and the second leg 28. In one example, the first valve core engaging surface 62 is disposed at a first angle 66 to a plane parallel to the longitudinal axis A of the shaft 11 and the second valve core engaging surface 64 is disposed at a second angle 68 to a plane parallel to the longitudinal axis A of the shaft 11. In certain example embodiments, the first angle 66 and the second angle 68 are equal or substantially equal. In other example embodiments, the first angle 66 and the second angle 68 are different. The first angle 66 and the second angle 68 can be between 1-45 degrees.

Figure 7:
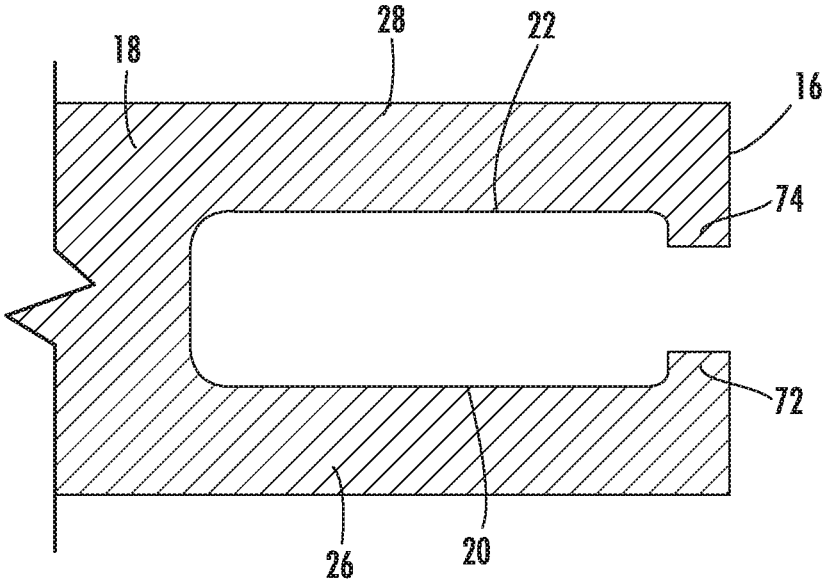
FIG. 7 is a partial side elevation view of another valve core grip for the valve core removal tool, in accordance with another example embodiment of the disclosure.

In another example embodiment, as shown in FIG. 7, each of the valve core engaging surfaces 20 and 22 can be disposed at or substantially at a zero angle (e.g., parallel or substantially parallel) to the longitudinal axis A of the shaft 11. In this example, the spacing between the first valve core engaging surface 20 and the second valve core engaging surface 22 is constant or substantially constant along the longitudinal axis A. The first leg 26 can further include a first gripping member 72 disposed along the free end of the first leg 26. In one example, the first gripping member 72 can extend orthogonally or substantially orthogonally to the longitudinal axis A of the shaft 11 from the second valve core engaging surface 22 and towards the second leg 28 such that the first gripping member 72 reduces the spacing between the first leg 26 and the second leg 28 at the distal end 16 of the tool 10. The second leg 28 can further include a second gripping member 74 disposed along the free end of the second leg 28. In one example, the second gripping member 74 can extend orthogonally or substantially orthogonally to the longitudinal axis A of the shaft 11 from the second valve core engaging surface 22 and towards the first leg 26 such that the second gripping member 74 reduces the spacing between the first leg 26 and the second leg 28 at the distal end 16 of the tool 10. In this embodiment, the distance between a free end of the first gripping member 72 and the second gripping member 74 is less than the distance between the first valve core engaging surface 20 and the second valve core engaging surface 22.

In another alternative embodiment, the rate of increase can vary (e.g., a variable angle) as you move from the free ends of the first leg 26 and the second leg 28 towards the fixed end of each of the first leg 26 and the second leg 28. In one example, the first valve core engaging surface 62 is disposed at a first angle 66 to a plane parallel to the longitudinal axis A of the shaft 11 and the second valve core engaging surface 64 is disposed at a second angle 68 to a plane parallel to the longitudinal axis A of the shaft 11. In certain example embodiments, the first angle 66 and the second angle 68 are equal or substantially equal. In other example embodiments, the first angle 66 and the second angle 68 are different. The first angle 66 and the second angle 68 can be between 1-45 degrees.

FIG. 2 is a perspective view of the valve core removal tool 10 gripping a valve core 24 according to one example embodiment of the disclosure. Referring to FIGS. 1A-2, when the valve core removal tool 10 is used to grip a portion of a valve core 24, the first and second valve core engaging surfaces 20, 22 can be configured to each flex outward in the B and C directions respectively to flexibly grip the valve core 24 therebetween. In the example embodiment of FIG. 2, the first valve core engaging surface 20 and the second valve core engaging surface 22 each engage a respective one of a multitude of wrench flats 30 disposed along one end of the valve core 24. As the respective first 20 and second 22 valve core engaging surface is axially and/or rotationally pressed into engagement with the outer surface of the valve core 24, such as one of a multitude of wrench flats 30 disposed circumferentially along the outer surface of the valve core 24, the respective first leg 26 and second leg 28 is flexed outwardly in the directions B and C respectively to, in turn, move the valve core engaging surfaces 20, 22 from the first or spring-biased position into the second or flexed position and thereby flexibly engage and grip the outer surface of the valve core 24.

In the first or spring-biased position, the first 20 and second 22 valve core engaging surfaces form an interference fit with respective flats 30 on the valve core 24. In the second or flexed position, as shown in FIG. 2, each of the first leg 26 and second leg 28 and the corresponding first 20 and second 22 valve core engaging surfaces, respectively, are flexed radially outwardly relative to the first or spring-biased position to allow each of the first 20 and second 22 valve core engaging surfaces to flexibly engage the respective flats 30 on the valve core 24 and grip the valve core therebetween.

Figure 3:
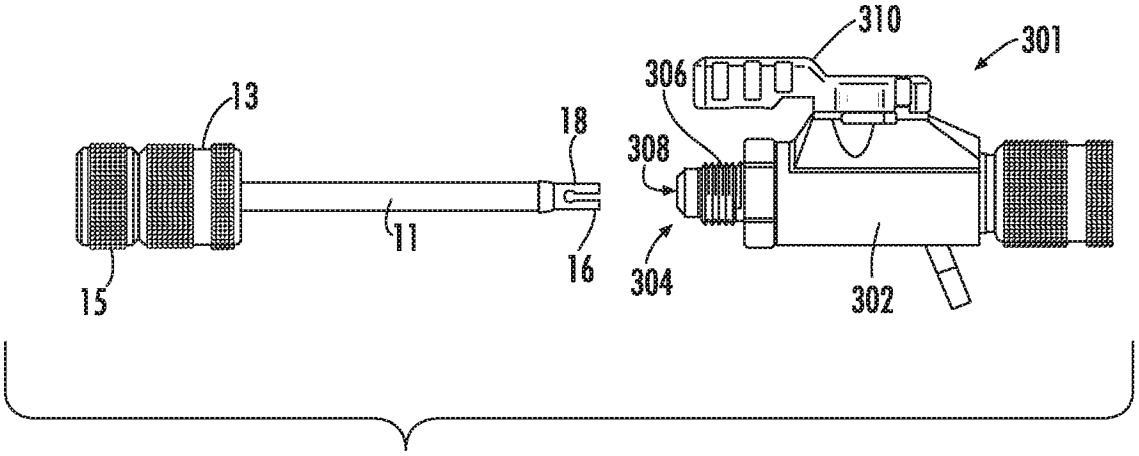
FIG. 3 is a side elevation view of the valve core removal tool and a valve, in accordance with one example embodiment of the disclosure.
Figure 4A:
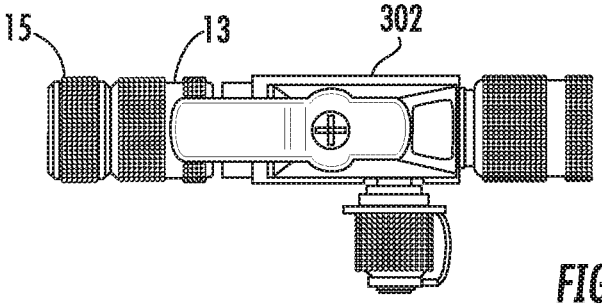
FIG. 4A is a top plan view of the valve core removal tool coupled to the valve, in accordance with one example embodiment of the disclosure.
Figure 4B:
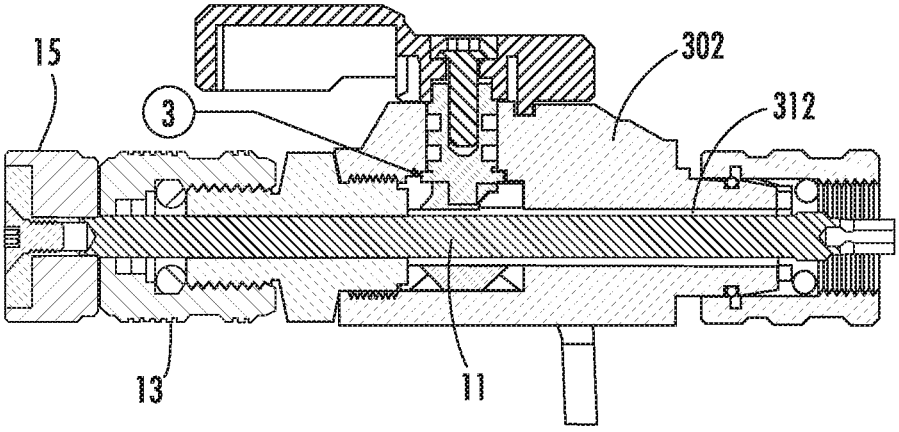
FIG. 4B is a cross-sectional view of the valve core removal tool coupled to the valve, in accordance with one example embodiment of the disclosure.

FIG. 3 is a side elevation view of the valve core removal tool 10 and a valve 301 that the valve core removal tool 10 can be attached to, according to one example embodiment of the disclosure. FIGS. 4A and 4B are various views of the valve core removal tool 10 coupled to the valve 301 for a removal of the valve core according to one example embodiment of the disclosure. Now referring to FIGS. 1A-4B, the valve 301 can be any type of valve and can include a valve body 302 and an attachment portion 304 for removably attaching a valve core removal tool 10 to the valve. In certain example embodiments, the valve 301 can also include an actuator 310 for manually adjusting the amount of flow of air/fluid through the valve.

The attachment portion 304 of the valve 301 can include a threaded exterior surface 306 for threadably coupling the swivel nut 13 to the valve body 302. The attachment portion can also include an opening 308. The opening 308 can provide an entry point for the first leg 26, second leg 28 and shaft 11 to be inserted into a valve core passageway 312 in communication with the opening 308. In use, the first leg 26, second leg 28 and at least a portion of the shaft 11 can be inserted into the opening 308 and the valve core passageway 312. The swivel nut 13 can then be moved along the longitudinal axis A of the shaft 11 to be threadably and rotatably coupled to the valve body 302 using the threads 19 and the threaded exterior 306. The plunger handle 15 can then be pushed towards the valve body 302 and in the direction of the longitudinal axis A to further insert the shaft 11 into the valve core passageway 312 (as the swivel nut 13 slides in the opposing direction along the longitudinal axis A of the shaft 11) until the first valve core engaging surface 20 and the second valve core engaging surface 22 contact the valve core 24. Further pushing of the plunger handle towards the valve body 302 and in the direction of the longitudinal axis A can cause at least a portion of each of the first leg 26 and the second leg 28 to flex or bend outwardly in the directions B and C respectively to increase the space or gap between the first valve core engaging surface 20 and the second valve core engaging surface 22 until the space or gap is sufficient to allow at least a portion of the valve core 24 to be slidably inserted between the first valve core engaging surface 20 and the second valve core engaging surface 22. Each of the first valve core engaging surface 20 and second valve core engaging surface 22 can then be disposed adjacent to one of a multitude of wrench flats 30 disposed circumferentially along an outer surface of the valve core 24 and can forcibly grip the valve core 24. The plunger handle 15 may then be rotated counter-clockwise about the longitudinal axis A. The rotation of the plunger handle 15 can cause a corresponding rotation of the shaft 11 and first leg 26 and second leg 28. The contact between the first valve core engaging surface 20 and second valve core engaging surface 22 with the corresponding wrench flats 30 on the valve core 24 can further cause a corresponding rotation of the valve core 24 to unscrew the valve core 24 from the valve 301. Once the valve core 24 is unscrewed from the valve 301, the plunger handle can be pulled away from the valve body 301 in the direction of the longitudinal axis A to move the valve core 24 through the valve core passageway 312. The swivel nut 13 can be unscrewed from the threaded exterior surface 306 of the valve 301 and the shaft 11, first leg 26, second leg 28, and the valve core 24 forcibly being held between the first valve core engaging surface 20 and second valve core engaging surface 22 with the spring force can be removed from the valve body 302. The actions described above can be completed in reverse to reinsert and reattach the valve core 24 to the valve 301.

Figure 5:
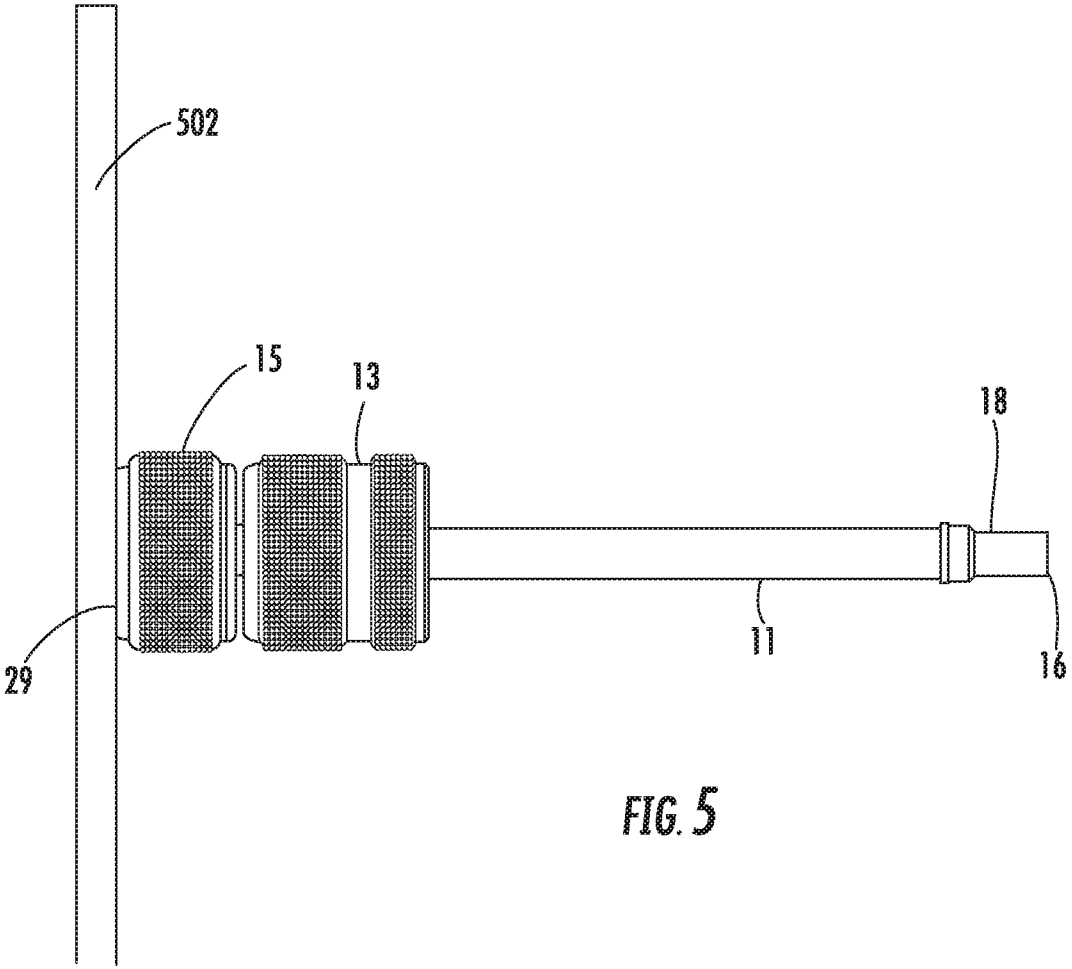
FIG. 5 is a side elevation view of the valve core removal tool magnetically coupled to a vertical surface, in accordance with one example embodiment of the disclosure.

FIG. 5 is a side elevation view of the valve core removal tool 10 magnetically coupled to a vertical surface according to one example embodiment of the disclosure. Now referring to FIGS. 1A-C, 2, and 5, as discussed herein, the valve core removal tool 10 can include a magnet 29 disposed on the proximal end 14 of the tool 10. In one example, all or at least a portion of the magnet 29 can be embedded into a cavity 33 in the top surface of the plunger handle 15. Alternatively, the magnet 29 can be disposed adjacent to the top surface of the plunger handle 15 at the proximal end of the tool 10. The magnet 29 can be any form of magnet suitable for magnetically mounting the proximal end 14 of the valve core removal tool 10 to a ferrous containing surface and supporting the weight of the tool and optionally a valve core 24 being held by the tool 10. In one example embodiment, the magnet 29 generates a magnetic force sufficient to magnetically attach the proximal end 14 of the tool 10 to, support the weight of the tool 10 and the valve core 24 on, and hold the tool 10 and valve core 24 in place on, a vertical ferrous containing surface, such as vertical surface 502.

Although example embodiments of the disclosure have been described, one of ordinary skill in the art will recognize that numerous other modifications and alternative embodiments are within the scope of the disclosure. Furthermore, while various example implementations and architectures have been described in accordance with example embodiments of the disclosure, one of ordinary skill in the art will appreciate that numerous other modifications to the example implementations and architectures described herein are also within the scope of this disclosure.

Certain aspects of the disclosure are described above with reference to example methods of use of the valve core removal tool. It will be understood that one or more steps of the described example methods may not necessarily need to be performed in the order presented, or may not necessarily need to be performed at all, according to some embodiments. Further, additional components and/or operations beyond those depicted in example methods may be present in certain embodiments.

Although example embodiments have been described in language specific to structural features and/or methodological acts, it is to be understood that the disclosure is not necessarily limited to the specific features or acts described. Rather, the specific features and acts are disclosed as illustrative forms of implementing the example embodiments. Conditional language, such as, among others, "can," "could," "might," or "may," unless specifically stated otherwise, or otherwise understood within the context as used, is generally intended to convey that certain example embodiments could include, while other example embodiments do not include, certain features, elements, and/or steps. Thus, such conditional language is not generally intended to imply that features, elements, and/or steps are in any way required for one or more embodiments.

What is claimed is:

1. A valve core removal tool comprising:
- an elongated shaft comprising a proximal end, a distal end, and an outer surface, the elongated shaft extending along a longitudinal axis thereof between the proximal end and the distal end, the outer surface extending between the proximal end and the distal end;
- a shoulder stop positioned at the distal end;
- a handle coupled to the proximal end of the elongated shaft;
- a swivel nut disposed between the handle and the distal end of the elongated shaft and slidable along the outer surface of the elongated shaft and configured to be threadably coupled to a valve body; and
- a valve core gripper diametrically lesser than the shoulder stop and monolithically extending from the shoulder stop, the valve core gripper comprising:
  - a first valve core engaging surface; and
  - a second valve core engaging surface spaced apart from the first valve core engaging surface, at least one of the first valve core engaging surface and the second valve core engaging surface is movable relative to the other of the first valve core engaging surface and the second valve core engaging surface between a first position defining a first distance between the first valve core engaging surface and the second valve core engaging surface, and a second position defining a second distance between the first valve core engaging surface and the second valve core engaging surface that is greater than the first distance.

2. The valve core removal tool of claim 1, wherein the valve core gripper further comprises:
- a first leg comprising a first fixed end coupled to the shoulder stop and a first distal free end, the first leg defining the first valve core engaging surface; and
- a second leg comprising a second fixed end coupled to the shoulder stop and a second distal free end, the second leg defining the second valve core engaging surface.

3. The valve core removal tool of claim 2, wherein each of the first leg and the second leg extend along a corresponding axis that is substantially parallel to the longitudinal axis of the elongated shaft.

4. The valve core removal tool of claim 2, wherein the first and second legs are opposed and laterally spaced relative to each other.

5. The valve core removal tool of claim 2, wherein the first leg and the second leg are flexibly coupled to the shoulder stop and configured to move between the first position and the second position and wherein each of the first leg and the second leg are spring-biased into the first position.

6. The valve core removal tool of claim 2, wherein the valve core gripper further comprises:
- a first recess formed in the first leg adjacent the first fixed end of the first leg; and
- a second recess formed in the second leg adjacent the second fixed end of the second leg; and
- wherein each of the first recess and second recess facilitates flexing of the respective first leg and second leg between the first and second positions.

7. The valve core removal tool of claim 1, wherein the first valve core engaging surface and the second valve core engaging surface are collectively configured to flexibly grip a valve core therebetween.

8. The valve core removal tool of claim 1, wherein the first valve core engaging surface comprises a first arcuate surface and the second valve core engaging surface comprises a second arcuate surface.

9. The valve core removal tool of claim 8, wherein each of the first arcuate surface and the second arcuate surface have a radius of curvature about a longitudinal axis of the elongated shaft.

10. The valve core removal tool of claim 1, wherein the handle comprises a planar base, wherein the handle comprises a non-magnetic housing having a cavity hosting a magnet therein such that the magnet is enclosed by the non-magnetic housing, wherein the non-magnetic housing and the magnet flushly define the planar base.

11. The valve core removal tool of claim 10, wherein the handle comprises a recessed surface and wherein the magnet is disposed within the recessed surface of the handle.

12. The valve core removal tool of claim 1, wherein the at least one movable first valve core engaging surface and the second valve core engaging surface is spring-biased in the first position to grip a valve core between the first valve core engaging surface and the second valve core engaging surface.

13. A valve core removal tool comprising:

an elongated shaft comprising a proximal end, a distal end, and an outer surface, the elongated shaft extending along a longitudinal axis thereof between the proximal end and the distal end, the outer surface extending between the proximal end and the distal end;

a shoulder stop positioned at the distal end;

a handle coupled to the proximal end of the elongated shaft;

a swivel nut disposed between the handle and the distal end of the elongated shaft and slidable along the outer surface of the elongated shaft and configured to be threadably coupled to a valve body; and a valve core gripper diametrically lesser than the shoulder stop and monolithically extending from the shoulder stop, the valve core gripper comprising:

a first means for flexibly engaging a first surface of a valve core; and a second means for engaging a second surface of a valve core located on a substantially opposite side of the valve core relative to the first surface, wherein the first means is spaced apart from the second means, the first means and the second means are movable relative to one another between a first position defining a first distance between the first means and the second means, and a second position defining a second distance between the first means and the second means that is greater than the first distance.

14. The valve core removal tool of claim 13, wherein the first means is a first valve core engaging surface, and the second means is a second valve core engaging surface, and the first and second valve core engaging surfaces are located on substantially opposite sides of the valve core gripper.

15. The valve core removal tool of claim 13 further comprising a means for removably coupling the valve core removal tool to a vertical surface.

16. The valve core removal tool of claim 15, wherein the means for removably coupling the valve core removal tool to the vertical surface is disposed along the proximal end of the elongated shaft.

17. The valve core removal tool of claim 15, wherein the means for removably coupling the valve core removal tool to the vertical surface comprises a magnetic means.

18. The valve core removal tool of claim 13, wherein the first means and the second means is spring-biased in the first position to grip a valve core between the first means and the second means.

19. The valve core removal tool of claim 13, wherein the first means comprises a first leg comprising a first fixed end coupled to the shoulder stop and a first distal free end, the first leg defining the first valve core engaging surface; and a second leg comprising a second fixed end coupled to the shoulder stop and a second distal free end, the second leg defining the second valve core engaging surface.

20. A valve core removal tool comprising:

an elongated shaft comprising a proximal end, and a distal end, the elongated shaft extending along a longitudinal axis thereof between the proximal end and the distal end;

a shoulder stop positioned at the distal end;

a handle coupled to the proximal end of the elongated shaft; and a valve core gripper diametrically lesser than the shoulder stop and monolithically extending from the shoulder stop, the valve core gripper comprising:

a first leg comprising:

a first fixed end coupled to the shoulder stop;

a first recess formed in the first leg adjacent the first fixed end of the first leg; and a first distal free end, the first leg defining a first valve core engaging surface; and a second leg spaced apart from the first leg and comprising:

a second fixed end coupled to the shoulder stop;

a second recess formed in the second leg adjacent the second fixed end of the second leg; and a second distal free end, the second leg defining a second valve core engaging surface spaced apart from the first valve core engaging surface, wherein at least one of the first leg and the second leg is movable relative to the other of the first leg and the second leg between a first position defining a first distance between the first valve core engaging surface and the second valve core engaging surface, and a second position defining a second distance between the first valve core engaging surface and the second valve core engaging surface that is greater than the first distance.

21. The valve core removal tool of claim 20, wherein at least one of the first valve core engaging surface and the second valve core engaging surface is spring-biased in the first position to grip a valve core between the first valve core engaging surface and the second valve core engaging surface.

* * * * *